US008479448B1

(12) United States Patent
Mercado

(10) Patent No.: US 8,479,448 B1
(45) Date of Patent: Jul. 9, 2013

(54) RUT-LESS ROLLER GATE SYSTEM, FULLY SUPPORTED AND BALANCED OFF GROUND

(76) Inventor: David Marshall Mercado, San Antonio, TX (US)

( * ) Notice: Subject to any disclaimer, the term of this patent is extended or adjusted under 35 U.S.C. 154(b) by 20 days.

(21) Appl. No.: 13/160,677

(22) Filed: Jun. 15, 2011

Related U.S. Application Data

(60) Provisional application No. 61/392,141, filed on Oct. 12, 2010.

(51) Int. Cl.
*E05D 13/00* (2006.01)

(52) U.S. Cl.
USPC ..... 49/409; 49/425; 49/410

(58) Field of Classification Search
USPC ..... 49/404, 409, 410, 411, 324, 360, 49/425; 356/73
See application file for complete search history.

(56) References Cited

U.S. PATENT DOCUMENTS

| | | | | | |
|---|---|---|---|---|---|
| 328,748 | A * | 10/1885 | Basnett | 49/409 |
| 601,257 | A * | 3/1898 | Jenkins | 49/409 |
| 3,318,048 | A * | 5/1967 | Odend Hal | 49/223 |
| 3,705,468 | A * | 12/1972 | Ashworth | 49/409 |
| 5,136,813 | A * | 8/1992 | Gibbs et al. | 49/404 |
| 5,680,729 | A * | 10/1997 | Heffington | 49/362 |
| 2006/0107596 | A1 * | 5/2006 | Ohata | 49/73.1 |

* cited by examiner

*Primary Examiner* — Katherine Mitchell
*Assistant Examiner* — Catherine A Kelly

(57) ABSTRACT

A rolling gate (15) fully supported off the ground on three rails (14), (16), (20), which are supported on three in line horizontally spaced vertical posts (17), (18), (19). The frame (15) outside the fence line has two roller appendages (12), (13) that span the fence line and ride on the rails (14), (16) inside the fence line. The bottom longitudinal pipe member of gate (15) is a bottom rail (20). A middle roller (11) mounted low on post (18) inside the fence line extends across the fence line to control rail (20) outside the fence line. The rails have a minute separation making the gate like a train on tracks. The rails (14), (16) have adjustable connectors (22), (23) and are adjusted level. The leveling keeps bottom rail (20) level during operation and allows all three rollers (12), (13), (11) to maintain contact the entire length of rails (14), (16), (20).

10 Claims, 8 Drawing Sheets

RUT-LESS ROLLER GATE SYSTEM, FULLY SUPPORTED AND BALANCED OFF GROUND

CROSS-REFERENCE TO RELATED APPLICATIONS

This application claims the benefit of provisional patent application 61/392,141 filed on 2010 Oct. 12 by the present inventor.

BACKGROUND PRIOR ART

The following is a tabulation of some prior art that presently appears relevant:

| U.S. patents | | | |
|---|---|---|---|
| Pat. No. | Kind Code | Issue Date | Patentee |
| 885,288 | | Apr. 21, 1908 | Robert G. Ping |
| 935,206 | | Sep. 28, 1908 | Amos K. Holdeman |
| 3,257,756 | | Jun. 28, 1966 | Marvin R. Mealer |
| 4,791,757 | | Dec. 20, 1988 | Paul F. Orlando |
| Des. 251,702 | | May 1, 1979 | Leo J. Martini |
| U.S. Pat. No. 7,581,353 | B1 | Sep. 1, 2009 | Bruce G. Gill, Douglas J. Blanchard |
| 3,613,314 | | Oct. 19, 1971 | Francis L. Ford |

BACKGROUND

The present invention relates to apparatus that cover and uncover an opening at an access point such as the type resembling a gate closure sliding edgewise across an opening in a fence. There have been many different configurations of gates employed in the past such as swinging gates supported by some type of hinge, sliding cantilever gates, and sliding gates with a grooved roller and an inverted v-shaped rail on the ground are just a few configurations. Most wide swinging gates sag from the hinges after too short a time period. The swinging gate also needs room for the gates to swing, this area used for the swing of the gate could be space used for other purposes. The cantilever gate constructed in several previous inventions appears to address the problem of having a gate that opens and closes without a wheel on the ground. The cantilever gates are of a lavish rail design that would require detailed manufacturing and expert installation. There are extra stresses encountered on most cantilevered construction. Usually cantilever items are given a shorter life expectancy due to the extra stresses at their connecting points.

The gate that seems to be used in most situations now days is in the form of a gate with two rollers under the bottom ends of a frame that ride on a single track on the ground. The roller under the free end can be knocked off if bumped by an automobile. An electric motor turns a sprocket that moves a long loop of chain. The chain loops a trolley attached near the free end of the gate. The trolley on the frame moves the gate back and forth. The rectangular frame is controlled and held in its vertical position by two or four posts on the gate receiving side of the opening. The posts have rollers at their top end that keep the upper longitudinal member of the frame between them. There is a minute warble on the free end of the gate as it moves due to lack of top end support. The rail on the ground needs a hard surface to keep it from burying into the ground and bending. Thus, it is believed that a need exists for an improved gate apparatus that does not touch the ground and travels quicker and more securely than gates presently known.

Francis Ford, U.S. Pat. No. 3,613,314 has prior art showing a larger double wheel under one end of a rectangular frame. This type system is best with a hard packed surface for the double wheel to ride on or it is likely to create ruts. I believe the reason for the double wheel is to steady the free end, but the double wheel on soft ground would leave two ruts that might eventually turn into one large rut. Marvin R. Mealer, U.S. Pat. No. 3,257,756, shows an embodiment that uses a recessed rail in the ground. The frame structure designed to support the frame looks like a cat's cradle of steel tubes. The rails appear to be designed to support the uneven weight distribution of the gate. I believe that many gate builders would agree that this gate system is not the optimum in gates.

My own patent addresses the problems discussed and at the same time makes it easy for the layperson to envision installing this system. The adjustable rails and the low adjustable roller on the middle post makes installation of this gate system easy enough for one person to accomplish. When the two upper rails are leveled; a bottom rail becomes level since it is part of the frame. A simple bubble level put my first alignment of the gate very close to the needed settings to make all rollers maintain contact the entire path of the gate. The bottom rail is the bottom longitudinal member of the gate frame. The wheel on the ground problem is solved by adding an adjustable roller to hold the bottom rail off the ground. Heavier gates may need fixed supports. In my attempt to solve the rut problem, I built a really well balanced gate, but nevertheless all the sliding gates heretofor known suffer from a number of disadvantages:

(a) Swinging gates have all their stresses transferred to the hinges holding the hanging mass of the structure. The hinges usually have a short life and need to be replaced. Room is needed to swing the structure open or closed.

(b) Cantilever gates also have great stresses at the points where the weight is transferred to the base. Many of the cantilever systems with patents have rails with great detail in their structure with many bends around the rollers that ride inside the rail. These bends must be there for strengthening purposes. The many bends in this type of rail will make errors in alignment multiply. These type gates appear to need professional installation.

(c) Gates that have a rail on the ground and a roller underneath a far end of the frame can be bumped off the track fairly easy. These gates look bulky and travel slowly. The rail on the ground requires a hard surface so that it does not sink into the ground and flatten out or bend or both.

(d) The trolley drive mechanism that moves the gate with power from an electric motor entails construction methods that might be too difficult for the average do it yourself person. The trolley on the gate with the long chain and its supporting and covering hardware may have to be done by a professional.

(e) The farther away the trolley gate gets from the electric motor as in going toward the closed position, the more work the motor does to move the gate.

This is probably why the motors for this system are so expensive, they have to be large.

SUMMARY

In accordance with the first embodiment, a sliding rolling gate comprises a rectangular frame of pipe tubing that has two appendages attached to the top ends of the frame, each appendage having a roller attached to the free end, there are two level rails upper and middle that are attached to fence posts, the roller appendages 12, 13 hang and ride on the two level rails 16,14, another roller attached low on the middle post will carry the third rail, which is the bottom longitudinal pipe member 20 of the gate frame.

ADVANTAGES

Accordingly several advantages of one or more aspects are as follows: to provide a sliding gate that does not require a wheel or roller on the ground, that does not require a track on the ground for a roller to ride on, that does not require a hard surface such as concrete, that will not create a rut if there is not a hard surface, that is balanced by several different aspects of weight distribution, that is light weight, that is relatively inexpensive to build, that is of very solid construction, that takes very little human energy to operate due to balance, that can have an electric motor installed for easier movement and remote operation, that is aesthetic, that can be used on an inclined surface longitudinally due to the rails being adjusted level, that stabilizes itself on separated rails much like a train, which has adjustable parts making it easier for a layperson to complete the task of leveling, having adjustable parts gives the layperson some leeway on measurement and placement of parts, that has three different rails with respective rollers each holding a third of the weight the entire slide. Other advantages of one or more aspects will be apparent from a consideration of the drawings and ensuing description.

DRAWINGS

Figures

DRAWINGS-REFERENCE NUMERALS

Figure 1:
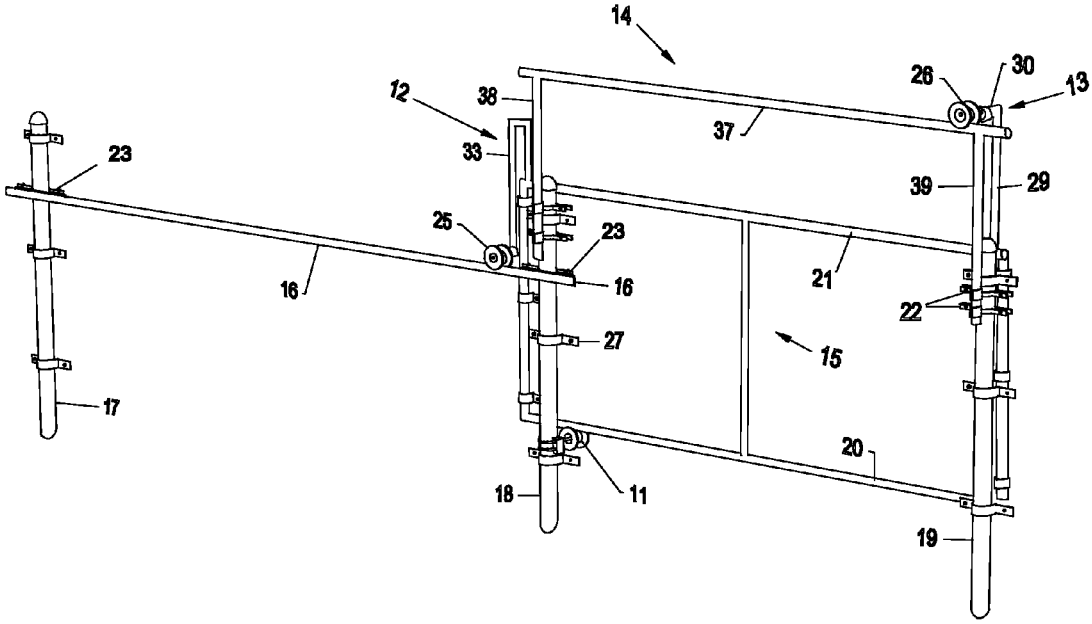
FIG. 1 shows a perspective view of all framework for this system. There is no sheathing in this gate closed view in accordance with one embodiment.

| | | | |
|---|---|---|---|
| 11 | bottom roller | 12 | roller appendage for middle rail |
| 13 | roller appendage for upper rail | 14 | overhead rail |
| 15 | gate frame | 16 | middle rail |
| 7 | post for middle rail end connection | 18 | middle post |
| 19 | post for upper rail connection | 20 | bottom rail |
| 21 | top tubular pipe of gate frame | 22 | connector, upper rail |
| 23 | adjustable connector, middle rail | 24 | sheathing fastener, gate |
| 25 | roller for appendage 12 | 26 | roller for appendage 13 |
| 27 | fastener for 2 × 4's | 28 | adjustable shaft, bottom roller |
| 29 | upright tube, appendage 13 | 30 | horizontal tube (appendage 13) |
| 31 | upright tube for appendage 12 | 32 | horizontal tube (appendage 12) |
| 33 | downward tube appendage 12 | 34 | base of bottom roller |
| 35 | ball bearing roller | 36 | knuckle |
| 37 | top pipe for overhead rail | 38 | end support for overhead rail |
| 39 | end support for overhead rail | 42 | electric motor |
| 43 | support for electric motor | 44 | electrical control box |
| 45 | shaft for electric motor | 46 | control box fastener |
| 47 | impregnated grooved roller | 48 | support for bottom roller |
| 49 | means for conveying rotational energy | 50 | end member of gate frame |
| 51 | other end member of gate frame | 52 | middle member of gate frame |

DETAILED DESCRIPTION FIRST EMBODIMENT

Figure 2:
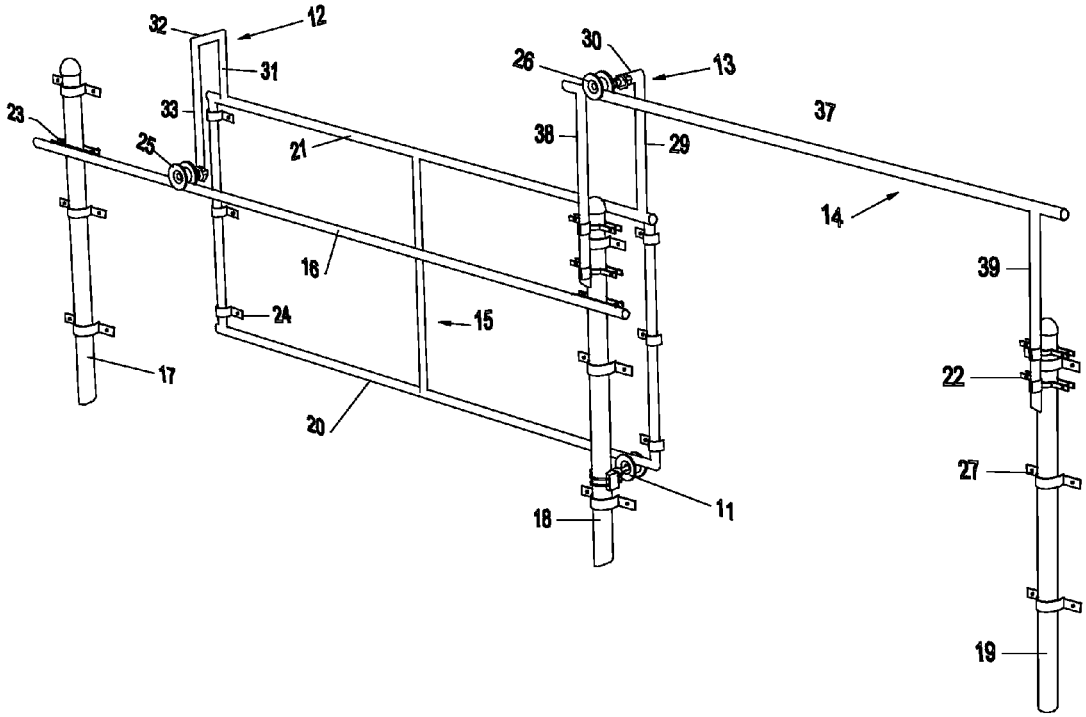
FIG. 2 shows the framework of all parts with the gate in the open position, no sheathing in accordance with one embodiment.
Figure 5:
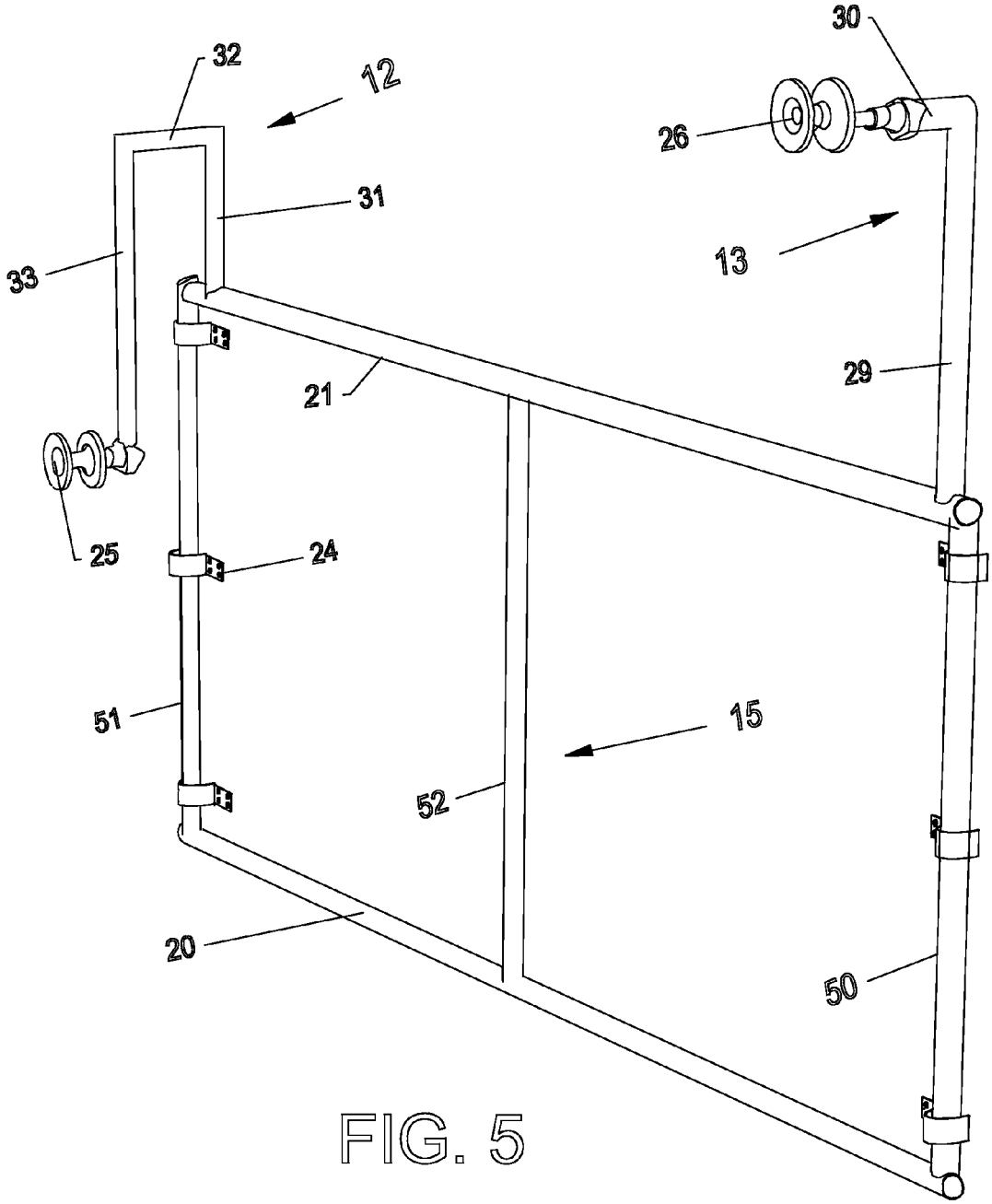
FIG. 5 shows a perspective view of the gate frame with a bottom rail, a roller appendage for the middle rail, and an upper roller appendage for the upper rail in accordance with one embodiment.
Figure 6:
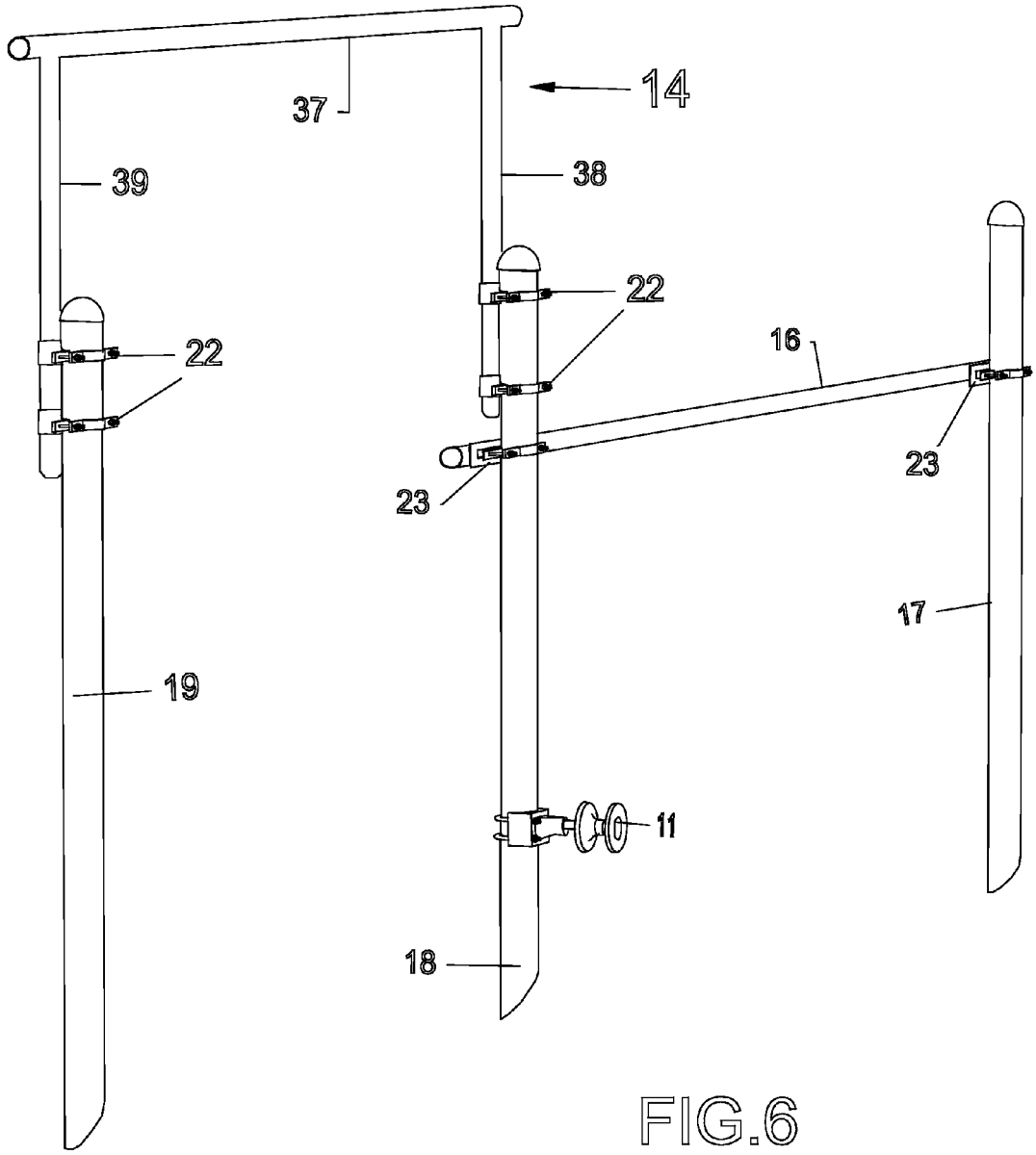
FIG. 6 shows the posts and rails for the gate frame and the bottom roller; the gate frame removed, from an outside perspective view without sheathing in accordance with one embodiment.
Figure 7:
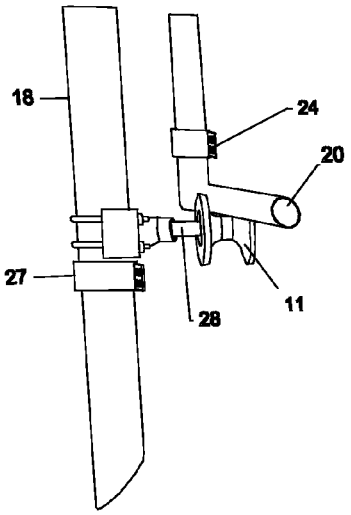
FIG. 7 shows a close up right side perspective view of the bottom roller, bottom rail of gate frame and extended pin (shaft) in accordance with one embodiment.

Referring to FIG. 1 (gate closed view of a framework) and FIG. 2 (gate open view) there is shown:

One embodiment of a gate frame 15 with structural support for a rut-less rolling gate system. The rolling gate system comprises three vertical in line posts 17, 18, and 19 that are horizontally spaced. A tubular rail 14 spans the gate opening overhead and is supported horizontally by post 18 and 19. A tubular rail 16 is supported horizontally by post 17, and 18 and is stationed behind and below a fence out of sight from an outside view. A planar rectangular gate frame 15 (FIG. 5) has two roller appendages 12, 13. The roller appendage 12 is on one end of the gate 15 and rides rotatably on rail 16. Another roller appendage 13 on the other end of the gate 15 rides rotatably on the upper rail 14. A bottom longitudinal member of the gate frame 15 is the bottom rail 20 (FIG. 5). A stationed roller 11 (FIG. 6, FIG. 7) is mounted low on the middle post 18 and will rotatably carry the bottom rail 20.

Figure 6A:
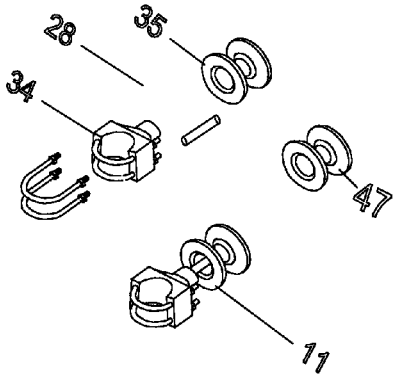
FIG. 6A through 6E show already known hardware and modified rollers, connectors, and adjusters in accordance with one embodiment.
Figure 6B:
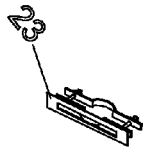
Figure 6C:
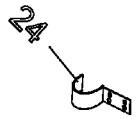
Figure 6D:
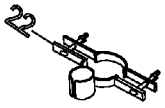
Figure 6E:
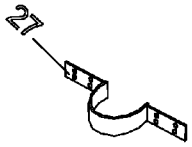

The already known hardware such as the ball bearing rollers 11 (FIG. 6A), these rollers are available from 1st Source Products, Inc., 2820 Sable Mill Road, Jeffersonville, Ind. The other parts such as adjustable connectors 23 (FIG. 6B), and 22 (FIG. 6D), and sheathing fasteners 24 (FIG. 6C) and 27 (FIG. 6E) can be purchased at fence hardware stores such as Lowes, or other similar acting parts may be employed. The constructed parts are made from metal tubular pipe (1⅝ galvanized fence rail used here but other tubing can be used) and some modified hardware. All constructed tubular pipe members will be referred to as tubes or pipes where possible. Some of the adjustable fasteners are modified and welded to the tubular pipe to eliminate hardware clutter, to make the system aesthetically trim-line, and for strength. In the method used here, all the pieces discussed for making parts are serially welded. There are other methods of accomplishing the same connecting tasks but the welding makes these parts very sound.

A horizontal overhead rail 14 (FIGS. 1,2,6) is made with three pieces of tubing. The rail 14 (FIGS. 1 thru 4) must be long enough to support the roller appendage 13 in the fully open or closed position. A horizontal tube 37 has two downward perpendicular members 38,39 attached fixedly to the ends. There are two connectors 22 spaced apart at the base of both downward tubes 38,39. The spacing will help give vertical support to rail 14 when the adjustable connectors 22 are tightened onto the opening posts 18,19. The horizontal tube 37 is long enough for the downward tube members 38, 39 to attach vertically to the opening posts 18, 19. The height of the tubes 38, 39 is dependent on the overhead clearance height wanted for the rail 14. The connectors 22 are tightened to the top space of the posts 18, 19. Another method of raising the upper rail would be to use longer posts 18,19 instead of using the downward members 38, 39.

A rail 16 needs to be at least as long as the gate frame 15 length longitudinally so that the roller appendage 12 has enough rail to roll on in the fully open or closed position. The rail 16 (FIGS. 1, 2, 6) is a piece of horizontal pipe with a connector 23 welded (or attached by suitable means) to each end. The rail 16 spans the distance between post 17, and 18. The rail 16 is tightened to the posts 17, 18 with the end connectors 23. The midline marks of the connectors 23 should line up with a vertical midline of posts 17, 18 for easier adjustment. The vertical midline of the posts are perpendicular to the fence line. The middle post holds both connectors 22, 23. The rail 16 will at least be below the adjustable connectors 22 for rail 14.

A connector 23 (FIG. 6B) is a standard metal post to 2 by 4 wood connector. The connector has adjustable U clamps with nuts, and it also has a punched out strip of metal for attaching sheathing. The rail 16 uses the connector 23 without any modification to the connector 23. Just weld the punched out strip of metal used for sheathing to the ends of tube 16. The connector 22 (FIG. 6D) is used on rail 14. The connector 22 is modified from connector 23 by bending and welding the punched out strip of metal around the bottom ends of the tubes 38, 39. The connectors 22 are spaced apart several inches to instill vertical sturdiness (suitable brackets can be used to level rail 14).

The gate frame 15 (FIG. 5, FIG. 2) is one unit comprising a rectangular planar frame of tubular pipe with two roller appendages 12,13 fixed to the top ends, and another important part of this system, the bottom rail 20. The rectangular frame portion is made by welding the top and bottom horizontal tubes 21, 20 to the longitudinal ends of the vertical tubes 50, 51 and 52 (FIG. 5). There are three permanent sheath fasteners 24 (FIG. 6C) welded onto each vertical end member 50,51 of the gate frame 15. The height of the frame or the separation distance between the tubular pipe 21 and pipe 20 (56 inches here) should be enough to set the bottom rail 20 into the bottom roller 11 and have equal parts of the sheathing showing above and below the frame. The gate frame 15 length longitudinally should be enough to overlap the posts 18, 19 for the opening. This will cover the ends of the fence on both sides of the opening and make it look like part of the fence from an outside view. Pay attention to making the gate frame 15 square so that the bottom rail 20 will travel level when the upper rail 14, and the middle rail 16 are leveled.

Figure 6F:
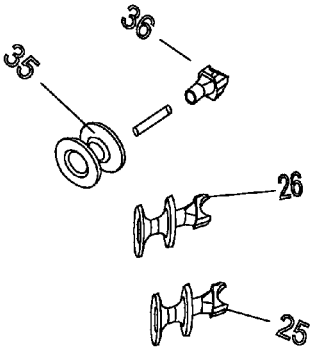

The appendages 12, 13 (FIG. 5) use the same basic trimmed down roller 25, 26 (FIG. 6F) in their construction. To modify the roller pin base 34 (FIG. 6A) into the appendage rollers 25, 26, toss the u-bolts aside and cut away excess metal to eliminate bulkiness and give the tubular pipes 30,33 a good weld fit. The trimmed down base 34 will now be referred to as a knuckle 36 (FIG. 6F). The round shape of the tubing pieces 30,33 which attach to the knuckle 36 can fully fit on only certain areas of knuckle 36. The trimmed roller 25 that uses the middle rail 16 has a connecting tube 33 approaching from the top. The trimmed down roller 26 uses the upper rail 14 and has a horizontal connecting tube 30 approaching from the rear.

Figure 3:
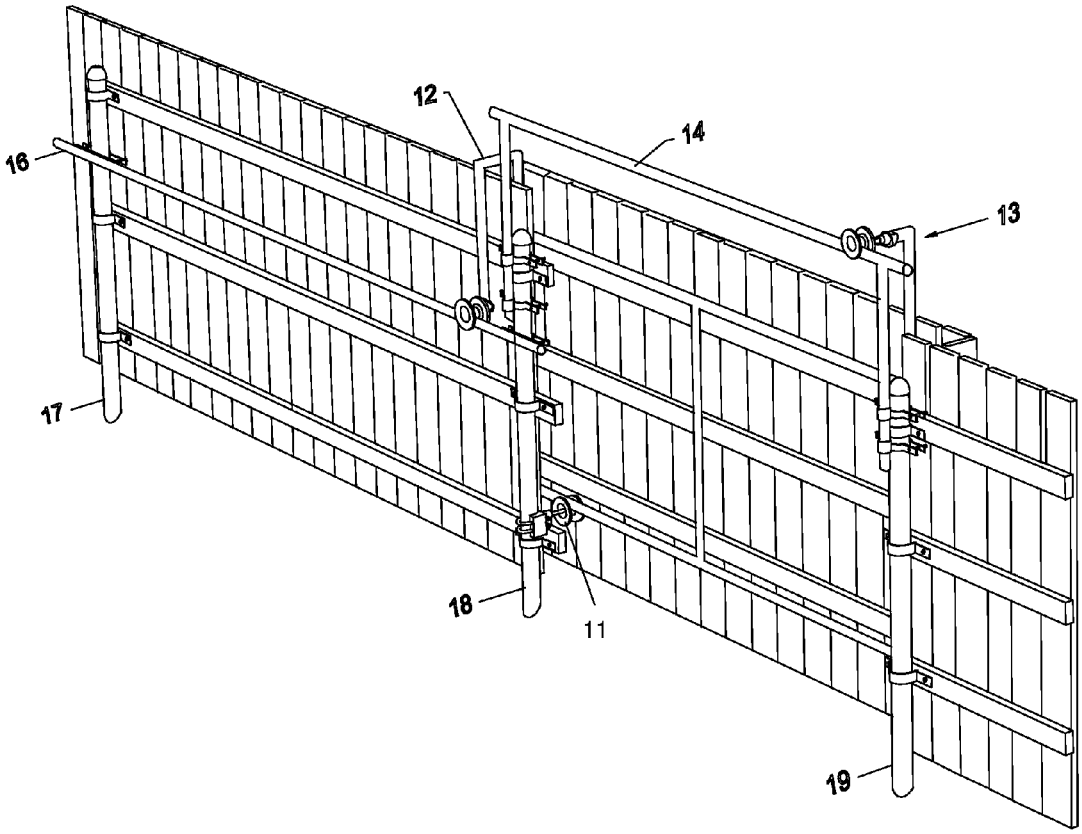
FIG. 3 shows a perspective view with sheathing from inside of a gate in the closed position in accordance with one embodiment.
Figure 4:
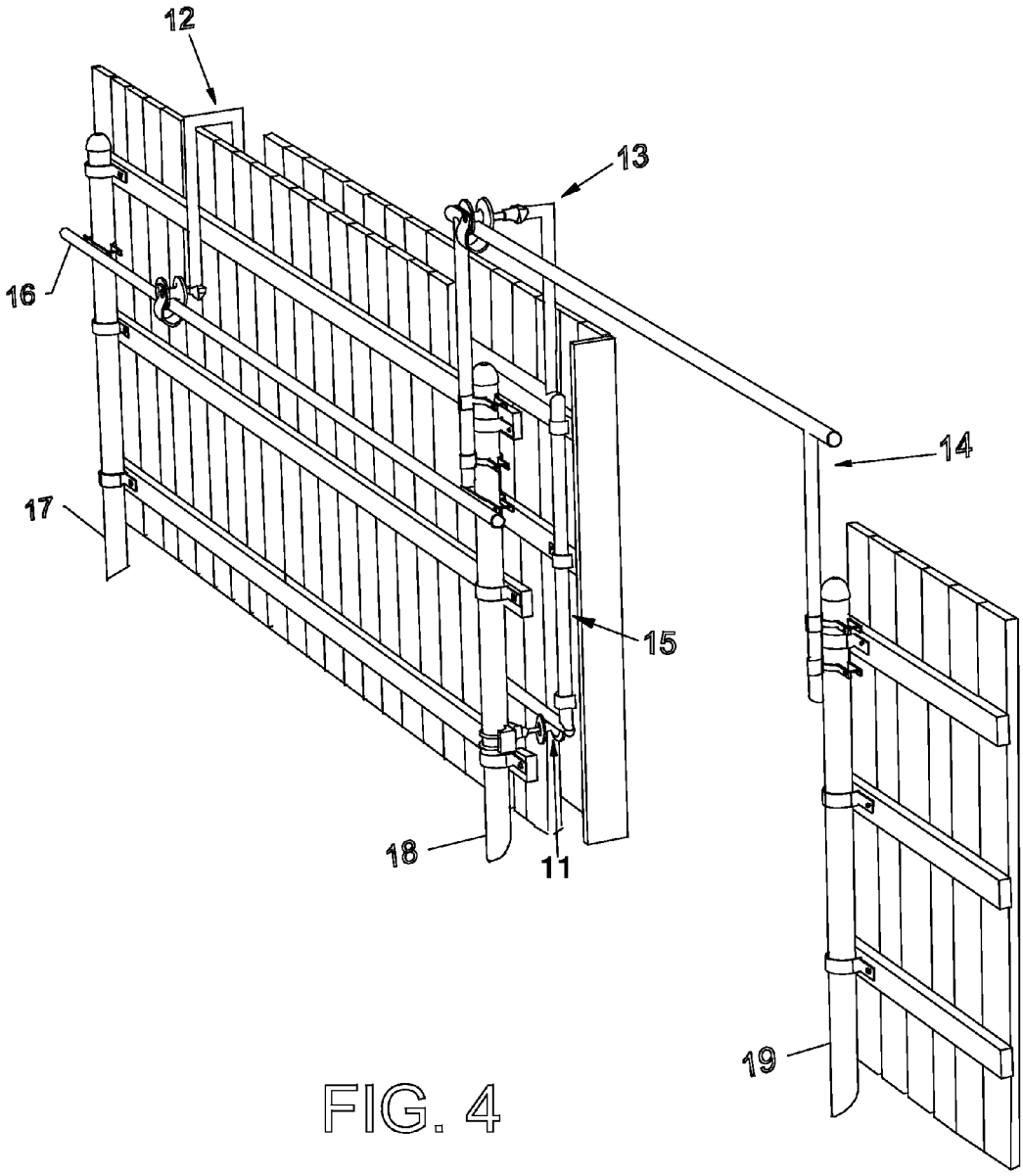
FIG. 4 shows an upper perspective view of the framework with sheathing and in the open position in accordance with one embodiment.

The appendage 12 (FIGS. 1, 5) is made up of three pieces of serially welded tubular pipe. The object in making this part is to carry the weight of one top end of the gate 15, cup the fence, and get the correct alignment for an attached roller 25 to fit rotatably on rail 16. A tubular pipe 31 is welded at its base to the top of longitudinal tube 21 near one end. The tube 31 extends (10 inches here) vertically upward enough to make an attached horizontal tubular pipe 32 clear the top of the fence throughout the entire slide path (FIGS. 3,4). The tube 32 is long enough (7½ inches here) to span the fence and reach a perpendicular position over rail 16. A tubular pipe 33 is welded downwardly perpendicular to tube 32. The tube 33 length is (21 inches here) dependent on the rail 16 positioning height which is adjustable. The tubular pipe 33 is welded perpendicular to the top of knuckle 36 so that the roller 25 aligns on top of rail 16 as oriented in the drawings.

The appendage 13 (FIGS. 3,4,5) has one 90-degree angle in its construction. A tubular pipe 29 is welded to the top of the horizontal tube 21. The tube 29 extends (20 inches here) vertically upward in plane with the rectangular face of the gate frame 15 and perpendicular to the top of the pipe 21. The pipe 29 length is dependent on the overhead clearance height of rail 14. A pipe 30 is welded perpendicular to the top end of pipe 29 and spans the fence line far enough to attach to roller 26 sitting on rail 14. Welding the tube 30 into the back of the knuckle 36 will keep roller 26 in correct rolling alignment with rail 14. The length of tube 30 (6½ inches here) is the distance between upright tube 29 outside the fence line and roller 26 positioned on rail 14 inside the fence line. The appendage roller 13 rides on upper rail 14.

A bottom roller 11 (FIGS. 1, 2, 6) is placed at the bottom of post 18 (8 inches from ground here) where it cradles bottom rail 20. A shaft or pin 28 (FIG. 6A) will need a length of round bar welded on so roller 35 (FIG. 6F) can extend across the fence line to control the bottom gate rail 20. The length of this pin 28 will depend on how tightly or widely all the hardware and sheathing for the gate and fence lay out (4 inches added here). A small electric motor the size of an ordinary garage door opener could be added to roller 11 and be able to open and close the smaller lighter construction versions of this gate.

There are some adjustments to making this system if the gate opens in the opposite direction shown in the drawings.

Appendage 12, and 13 will have to exchange positions from the locations shown in these drawings. Another change will be that rail 16 and roller 11 will need to be moved to the post 19 side of the opening and another post on that side of the opening used for the far end of rail 16.

Operation First Embodiment

A gate frame 15 (FIG. 1, thru 4) rolls back and forth adjacent to and outside the fence. The appendages 12, 13 (FIG. 4) span across the fence to ride on the rails 14, 16 inside the fence. The bottom roller 11 mounted low on the middle post 18 inside the fence spans across the fence line to cradle the bottom rail 20 outside the fence line. This is one way to explain the separation of rails that help stabilize the ride of the gate 15. The bottom roller 11 holds the bottom rail 20 off the ground and makes the gate frame 15 perpendicular from a side view. To make the adjustments to pin 28 so the gate rides perpendicular, first use a level to make the gate frame 15 plane perpendicular. Then use a stake to hold the bottom of the gate 15 in place for a measurement. Position the base 34 of the roller 11 into place on the bottom of post 18. Hold roller 35 with pin 28 together underneath rail 20 and take a measurement. The measurement is from the end of pin 28 to the tip of the mounting base 34 where pin 28 inserts. The pin 28 slides into the base about an inch so add an inch onto the measurement taken. Mark the spot on pin 28 for a tap hole. Base 34 has a retaining bolt (not shown) for pin 28.

Adjust the rail 14 to a level position at the overhead clearance height and tighten. The connector 23 is placed below the connector 22 on post 18. Level the rail 16 and tighten the connectors 23. The connectors 22, 23 must be placed opposite the sheathing on the supporting posts 17, 18, and 19 so they can be adjusted without interference from other hardware. This is a step that helps create more separation between the inside and the outside rails.

Building the gate frame 15 square will keep bottom rail 20 level as it slides when rails 14, and 16, are leveled. This will help make all three rollers maintain contact throughout the entire slide. Three roller contacts are accomplished by; first, adjusting rails 14 (FIG. 1) and 16 level. Second, hang the roller appendages 12,13 onto rails 14, and 16. Once the pin (shaft) 28 length is determined and fixed, lift roller 11 upwards on post 18 to balance the weight between the rollers 11, 25, 26. If rail 20 is not level adjust one of the upper rails 14, 16 to bring rail 20 into a level position and remember to re-level whichever rail needed to be moved. Slide gate 15 back and forth and adjust rail 14 and 16 and roller 11 until all rollers maintain contact continuously.

The gate frame 15 is balanced in several ways (FIG. 1). One way is that both top ends are supported by the appendages 12 and 13, and bottom roller 11 shares its support of bottom rail 20, from end to middle to the other end as the gate 15 opens and closes. There is one rail for each roller which will decrease the forces placed on the rails. Each roller will support one third the weight of the gate with bottom roller 11 relieving the middle stress at the belly of the gate 15. Another balance acquired is from staggering rails 14, 16, and 20 (FIGS. 1, 2) in a vertical direction. There is upper rail 14, middle rail 16, and bottom rail 20 placed nearly equidistant from each other. Another equilibrium of weight distribution comes from the separation of rails 14, and 16 (FIGS. 2, 3, 4) inside the fence line from rail 20 outside the fence line. The span between the gate frame 15 outside the fence and rails 14, and 16 inside the fence is small (approximately 7 to 11 inches here, inside and outside tube measurement) but the separation is enough to make gate 15 ride on the rails much like a train on tracks. There is minimal if any sideways play as this gate glides.

Another force occurs when gate 15 is hung on the rails 14, 16, the bottom of the gate 15 swings under toward the fence slightly (FIG. 5, FIG. 2). The extension of the appendages 12, 13 away from the perpendicular plane of frame 15 offsets the hanging balance slightly. The pin shaft 28 with roller 35 are extended out to make the gate perpendicular from a side view. The slight force created impinges inward against roller 11. This same inward force is why an electric motor with a roller placed in the same location as roller 11 will be perfect for moving the gate.

The final adjustments will be made by sliding gate 15 back and forth. The gate 15 should slide easily, if it does not slide easily re-adjust the upper rails 14, 16 or the bottom roller 11. An initial effort to get the weight of the gate 15 moving in a direction should be followed by very little effort to finish the objective. The rails 14, 16 are kept as level as possible while getting all three rollers to maintain contact throughout the length of operation. If any rollers are lifting off of the rails look to adjust the nearest connector to where the roller is lifting. It is easier to lower rails 14 and 16 rather than lifting on roller 11 if possible. This system can be used on inclines as long as they are not too steep. One system already built has an 11-inch drop within an 8-foot length. The level rails 14, and 16 allow the gate to operate on inclines. The gate 15 will slide out higher than the top part of the fence in the open position when operated on an incline.

The building of the gate frame 15 and the alignment and use of the supporting posts 17, 18, and 19 basically remain the same in all embodiments except for being constructed with heavier larger materials. The permanent attachment of the rails 14, 16, and the bottom roller 11 may be necessary with heavier materials.

Figure 8:
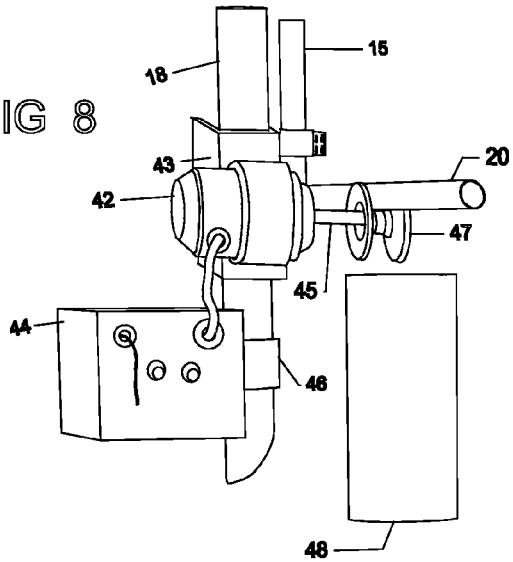
FIG. 8 shows a side perspective view of electric motor control of the bottom rail, and optional ground support for bottom roller in accordance only with another embodiment.
Figure 9:
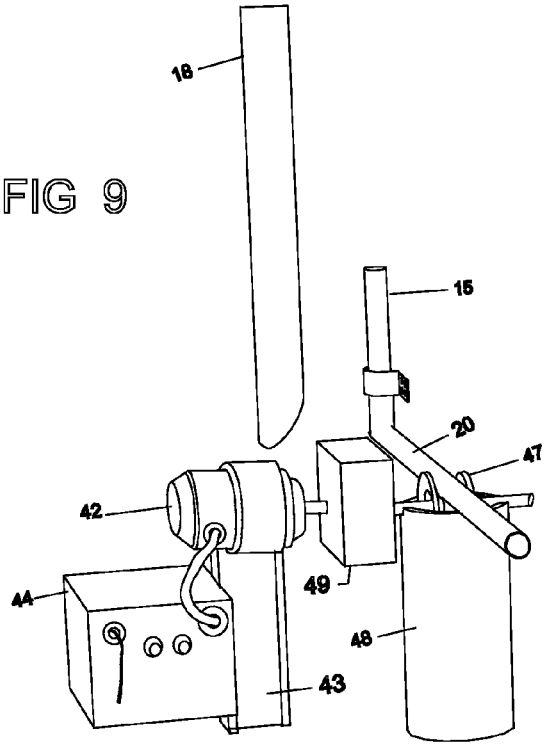
FIG. 9 shows an electric motor with ground support, and a bottom roller with ground support and a means for conveying rotational energy from an electric motor to the bottom roller in accordance only with another embodiment.

FIGS. 8,9 Additional Embodiments

Additional embodiments are shown in FIGS. 8, and 9, in each case there is an electric motor 42 added and a roller 47 replaces the bottom roller 11. The electric motor has a control box 44 (FIG. 8) for remote operation. All the equipment for moving the gate can be placed on the middle post except on larger systems that will require heavier equipment to move the gate. This goes along the same lines of thinking where the lighter models will be for a six foot opening in a backyard with no concrete and larger systems will be for a factory with pavement everywhere. It will make perfect sense to put the equipment such as motors, rollers and electrical function boxes on the ground when possible. The control box 44 is fastened off the ground by fastener 46 onto post 18 in FIG. 8. This control box can be any number of solid state radio-signal control systems. A motor drive shaft 45 may need extending to push rail 20 out to make the gate 15 perpendicular from a side view. The motor 42 is in control of the bottom rail 20 but is only carrying one third the weight of the gate reducing strain on the motor shaft 45. The motor 42 is fastened to post 18 with a motor connecting frame 43. The ground support 48 for the roller 47 is optional depending on the size and weight of the gate frame 15 and the capability of the motor 42 to handle the weight without strain. The frame built here weighs approximately seventy pounds estimated by lifting. Many electric motors would be able to handle one third this weight without too much strain on the motor parts. Even an electric motor used in a standard garage door opener could be used on the smaller lighter structured models The extension of the appendages 12, 13 away from the main body makes the bottom rail 20 swing inward slightly toward the fence when hanging on the upper rails 14,16. The inward impingement by the bottom of the gate 15 and one third the weight of the gate 15 will give roller 47 (FIGS. 6A, 8) at least two points of friction to drive rail 20 back and forth. The grooved roller 47 can be impregnated with a suitable material such as rubber to reduce any slipping. The direct drive motor 42 will eliminate several moving and connected parts used on sprocket and long chain drive gates. The direct drive motor 42 will make the gate open and close faster since it is in direct control of the bottom rail instead of having to go through several parts before the gate begins moving. The direct drive motor 42 has a better spin ratio to apply directly to the bottom rail making it move faster.

There are various possibilities with regard to the relative disposition of the electric motor 42 and the roller 47 cradling the bottom rail 20. A longer heavier gate 15 will require more support for the electric motor 42 and the bottom roller 47. The electric motor 42 in FIG. 9 has a ground support 43, and the roller 47 has a ground support 48. The control box 44 can be placed on the ground. Placing the motor 42, and roller 47 near the middle post 18 will maintain the middle control point. There may need to be some means for conveying rotational energy 49 from motor 42 to roller 47 depending on the frame 15 weight. The means can be an electro-magnetic clutch, or any other system that will help the electric motor 42 move the heavier gate with smooth transitions of power. The safety of the system when more powerful motors are involved includes having a trip switch that reverses the gate to the open position when the gate contacts an obstacle.

Advantages:

From the description above, a number of advantages of some embodiments of my gate system become evident:

(a) The top longitudinal ends of the gate frame are supported by the appendages and the bottom rail is supported by the bottom roller, from a front view, a three point triangle of support is formed by the three rollers. The rails are staggered in height, top, middle, and bottom. The rails are also separated with the two upper rails placed inside a fence line in one vertical plane and a bottom rail is outside the fence line in a different vertical parallel plane. The train-track like separation stabilizes the gate the entire path.

(b) The Rut-less Roller Gate System of the various embodiments can be used manually with ease when constructed of light tubing materials because of the ball bearing rollers and the exceptional balance of the frame. A person not wanting to deal with an electric motor will not have to worry about throwing their back out trying to move this gate. A gate that is constructed with larger materials to cover a larger opening will need an electric motor to move the gate.

(c) The three-point continuous balance of the rut-less system can use a smaller electric motor than other systems would use for a similar size gate. On the known trolley gate systems, it seems that the further the trolley mechanism moves away from the electric motor; the more work the motor has to do to move the gate. The motor and roller combination on my system are directly underneath the rail that is driven. The bottom roller on my system maintains direct continuous driving contact with the bottom rail. The bottom rail is actually a part of the structural integrity of the gate, not something added on solely to trolley the gate.

(d) Just a few manufactured parts and a few do it yourself tools can produce an aesthetic looking gate that will last a long time. An occasional squirt of garage door lube in the roller hubs and the rails makes the gate slide quietly. There is very little stress on individual parts, each roller 11, 12, 13 is carrying one third of the load.

CONCLUSION, RAMIFICATIONS, AND SCOPE

Accordingly, the reader will see that the rut-less rolling gate systems of the various embodiments can be used to open and close an opening in a fence easily, the free sliding action of the rollers and the complete three point balance, will allow larger gates to be powered by smaller electric motors, many gates now in use need electric motors so large to move them that the motors become the major expense of the entire system.

Furthermore, the rut-less gate system has the additional advantages in that:

- it permits the use of a sliding gate over any ground surface without creating a rut;
- it allows the use of smaller electric motors for larger gates due to phenomenal balance, the continuous contact, and the continuous close proximity of the working parts that move the gate; which include the motor, the bottom roller, and the bottom rail, keeping all the powered parts in a small accessible area will help if maintenance is required;
- it provides a new way of balancing gates so that lighter materials can be used to construct gates that now use larger heavier materials due to the method in which they are balanced and powered to move, the lighter gates will require less motor torque to move them in a direction;
- it provides a natural fit that makes the gate appear to be part of the fence from an outside view;
- it provides an aesthetic view from the outside with just a few parts showing above the fence sheathing, the upper rail shows about two thirds of its form above the fence sheathing, the appendage for the upper rail shows about two thirds of its form plus the roller that rides on top of the upper rail, and the appendage for the middle rail shows about one third of its cupping form above the fence sheathing.
- it provides a lightly constructed manual gate for smaller openings if an electric motor is not wanted, and it moves so easily that children and the elderly can use it easily;

Although the description above contains many specificities, these should not be construed as limiting the scope of the embodiments but as merely providing illustrations of some of several embodiments. For example, the tubing and the rollers can be of other shapes or materials that will allow rotatable action on a rail, the method of hanging the gate could be done in many different configurations and still hold to the basic three point continuous control with a bottom middle roller.

Thus the scope of the embodiments should be determined by the appended claims and their legal equivalents, rather than by the examples given.

I claim:

1. A slidably rolling rectangular gate frame supported off of a ground surface for covering and uncovering an opening comprising:

a top longitudinal rail and a bottom longitudinal rail;

first and second fixed appendages, wherein said first appendage extends upwardly from a first end of said top rail such that a first roller attached to a terminal end of said first appendage rides on a upper rail that is located above said top rail and spans overtop of said opening, and said second appendage having a first leg extending upwardly from a second end of said top rail, a base extending substantially perpendicularly from said first leg over a top edge of a fence, and a second leg extending downwardly from said base and substantially parallel to said first leg such that a second roller attached to a terminal end of said second leg of said second appendage rides on a middle rail located below said top rail;

wherein said bottom rail rides on a bottom roller mounted on a middle vertical post; and a ground structure to support said gate frame off said ground surface comprising said middle vertical post in line with and horizontally spaced between a first vertical post and a second vertical post, said middle post and said first post define said opening and support said upper rail, and said middle post and said second post support said middle rail.

2. The gate frame of claim 1 further including said upper rail with two perpendicular downward members one fixed to each end of said upper rail, said downward members are horizontally spaced to fit onto said first and said middle posts defining said opening, and an adjustable connector is fixed to terminal bottom ends of said downward members, said downward members attach to said first and said middle posts.

3. The gate frame of claim 1 further including an adjustable connector attached to each end of said middle rail, one end connects to said middle post and a other end connects to said second post away from said opening, said middle rail is positioned below said top edge of said fence.

4. The gate frame of claim 1 wherein an adjustable connector attaches said bottom roller to said middle post, a shaft on said bottom roller is extended to push said bottom rail outwardly so that said gate frame slides in a perpendicular position.

5. The gate frame of claim 1 wherein said upper rail and said middle rail are fastened on one side of said vertical posts, opposite a side supporting said fence, said bottom roller is located on said middle post on the fence side, so that said upper rail and said middle rail are in one vertical plane and said bottom rail is in a different vertical parallel plane.

6. The gate frame of claim 5 wherein an electric motor with a driving roller placed perpendicular to said bottom rail and mounted to said middle post so that said electric motor works in a direct drive manner to drive said gate frame.

7. The gate frame of claim 1 wherein an electric motor with a driving roller fixed to a motor shaft is in a direct drive control of said bottom rail, and said electric motor is attached on said middle post and is perpendicular to said bottom rail, and said electric motor has a mechanism for conveying multiple levels of rotational energy from said electric motor to said driving roller according to the conditions present at a given time, said electric motor and said driving roller move said gate frame back and forth, said electric motor has a electronic control mechanism for remote operation.

8. The gate frame of claim 1 wherein said gate frame is stabilized at three points, said three points of contact are said first, said second, and said bottom rollers which maintain continuous contact during movement of said gate frame from covering to uncovering said opening and from uncovering to covering said opening a weight of said gate frame is distributed equally through said first, said second, and said bottom rollers said upper, said middle, and said bottom rails.

9. A method of suspending the sliding gate frame of claim 1 off of the ground surface that slides back and forth outside and along the fence, comprising:

providing said gate frame having said top and said bottom rails and said first and said second appendages, said first, said second, and said bottom rollers, and said upper rail;

providing said ground support having said middle, said first, and said second vertical posts;

creating a swing under force along said bottom rail when said gate frame is hung on said upper rail and said middle rail, and when said bottom roller is adjusted to push said bottom rail outward until said gate frame is vertical, and placing a electric motor with a fixed roller in place of said bottom roller would take advantage of two forces, a downward force from one third of a gate frame weight and said swing under force, and said downward force and a inward force produced by said swing under force help said electric motor and said bottom roller move said bottom rail without slippage, and therefore move said gate frame.

10. The method of claim 9 further including said electrical motor with said fixed roller placed on said middle post in a position perpendicular to said bottom rail in order to use a direct drive method of power.

* * * * *